US009950896B2

(12) United States Patent
Stanton

(10) Patent No.: US 9,950,896 B2
(45) Date of Patent: Apr. 24, 2018

(54) BRAKING WRAP DISPENSER

(71) Applicant: Pratt Corrugated Holdings, Inc., Conyers, GA (US)

(72) Inventor: Christopher M. Stanton, Peachtree City, GA (US)

(73) Assignee: Pratt Corrugated Holdings, Inc., Conyers, GA (US)

( * ) Notice: Subject to any disclaimer, the term of this patent is extended or adjusted under 35 U.S.C. 154(b) by 0 days.

(21) Appl. No.: 15/606,361

(22) Filed: May 26, 2017

(65) Prior Publication Data

US 2017/0260020 A1 Sep. 14, 2017

Related U.S. Application Data

(63) Continuation of application No. 15/001,281, filed on Jan. 20, 2016, now Pat. No. 9,688,507, which is a (Continued)

(51) Int. Cl.
*B65H 75/18* (2006.01)
*B65H 16/00* (2006.01)
(Continued)

(52) U.S. Cl.
CPC ..... *B65H 75/30* (2013.01); *B65B 67/085* (2013.01); *B65H 16/005* (2013.01);
(Continued)

(58) Field of Classification Search
CPC .... B65B 67/085; B65H 75/30; B65H 16/005; B65H 75/185; B65H 75/406; B65H 2701/1752
See application file for complete search history.

(56) References Cited

U.S. PATENT DOCUMENTS 1,364,259 A 1/1921 Eaton
1,451,914 A 4/1923 Kongsrud
(Continued)

FOREIGN PATENT DOCUMENTS

DE 1924348 11/1970
DE 202004011730 11/2004
(Continued)

OTHER PUBLICATIONS

Dahlmann, Deborah A.; Notice of Allowance for U.S. Appl. No. 14/609,567, filed Jan. 30, 2015, dated Jul. 6, 2017, 17 pgs.
(Continued)

*Primary Examiner* — William A. Rivera
(74) *Attorney, Agent, or Firm* — Taylor English Duma LLP

(57) ABSTRACT

A film dispenser includes a holding member, the holding member including a first end and a second end joined to the first end. The holding member defines a longitudinal axis extending from the first end to the second end. The second end defines a brake portion, a connecting portion extending radially inward from the brake portion, and a slot defined in the brake portion. The slot includes a first portion extending in a circumferential direction across a width of the brake portion and second and third portions extending across a length of the brake portion. The slot further includes a fourth portion angled with respect to the second portion and a fifth portion angled with respect to the third portion, each of the fourth and fifth portions extending in a circumferential direction, the fourth and fifth portions of the slot intersecting the second and third portions, respectively.

20 Claims, 12 Drawing Sheets

Related U.S. Application Data continuation of application No. 14/108,881, filed on Dec. 17, 2013, now Pat. No. 9,272,870.

(51) Int. Cl.

| | |
|---|---|
| ***B65H 67/08*** | (2006.01) |
| ***B65H 75/30*** | (2006.01) |
| ***B65B 67/08*** | (2006.01) |
| ***B65H 75/40*** | (2006.01) |

(52) U.S. Cl.

CPC ..... *B65H 75/185* (2013.01); *B65H 75/406* (2013.01); *B65H 2701/1752* (2013.01)

(56) References Cited

U.S. PATENT DOCUMENTS

| | | | | |
|---|---|---|---|---|
| 1,935,392 | A | 11/1933 | Coninck | |
| 2,331,743 | A * | 10/1943 | Sullivan | B65H 75/243 242/571.2 |
| 3,856,229 | A | 12/1974 | Bryam | |
| 4,102,513 | A | 7/1978 | Guard | |
| 4,166,589 | A | 9/1979 | Hooever | |
| 4,179,081 | A | 12/1979 | Parry | |
| 4,226,380 | A | 10/1980 | Gay | |
| 4,248,392 | A | 2/1981 | Parry | |
| 4,339,022 | A | 7/1982 | Hoover | |
| 4,372,500 | A | 2/1983 | Saraisky | |
| D268,514 | S | 4/1983 | Thompson | |
| 4,477,037 | A | 10/1984 | Goldstein | |
| 4,484,717 | A | 11/1984 | Goldstein | |
| 4,530,473 | A | 7/1985 | Parry | |
| 4,575,020 | A | 3/1986 | Strout et al. | |
| 4,600,163 | A | 7/1986 | Hummel et al. | |
| 4,659,031 | A | 4/1987 | Saraisky | |
| 4,706,442 | A | 11/1987 | Riemenschneider | |
| 4,722,493 | A | 2/1988 | Parry et al. | |
| 4,752,045 | A | 6/1988 | Goldstein | |
| 4,784,348 | A | 11/1988 | McDonald | |
| 4,817,762 | A | 4/1989 | Powell | |
| 4,834,312 | A | 5/1989 | Riemenschneider, III | |
| 4,872,623 | A | 10/1989 | Parry et al. | |
| 4,874,139 | A | 10/1989 | Kewin | |
| 4,971,265 | A | 11/1990 | Koch | |
| 5,094,395 | A | 3/1992 | Lambert | |
| 5,135,179 | A | 8/1992 | Morano | |
| 5,150,852 | A | 9/1992 | Hunt et al. | |
| 5,186,376 | A | 2/1993 | Scharf et al. | |
| 5,190,237 | A | 3/1993 | Fagan | |
| 5,203,517 | A | 4/1993 | Parry et al. | |
| 5,351,905 | A | 10/1994 | Ferber | |
| 5,398,884 | A | 3/1995 | Stanford | |
| 5,409,177 | A | 4/1995 | Parry et al. | |
| 5,490,642 | A | 2/1996 | Schwartz | |
| D371,298 | S | 7/1996 | Reddy et al. | |
| 5,573,630 | A | 11/1996 | Edney et al. | |
| 5,664,739 | A | 9/1997 | Black et al. | |
| 5,868,334 | A | 2/1999 | Cedillo | |
| 5,915,642 | A | 6/1999 | Davis | |
| 5,927,635 | A | 7/1999 | Black et al. | |
| 5,938,142 | A | 8/1999 | Halperin | |
| 5,961,063 | A | 10/1999 | Parry | |
| 6,015,111 | A | 1/2000 | Berke | |
| 6,019,308 | A | 2/2000 | Huang | |
| 6,027,069 | A | 2/2000 | Huang | |
| D424,341 | S | 5/2000 | Anderberg | |
| D425,347 | S | 5/2000 | Anderberg | |
| 6,102,323 | A | 8/2000 | Riemenschneider | |
| 6,227,479 | B1 | 5/2001 | Dean et al. | |
| 6,227,480 | B1 | 5/2001 | Huang | |
| 6,398,150 | B1 | 6/2002 | Munter et al. | |
| 6,491,252 | B2 | 12/2002 | Komatsu et al. | |
| 6,508,430 | B1 | 1/2003 | Rodriguez | |
| 6,517,023 | B2 | 2/2003 | Rodriguez | |
| 6,651,918 | B2 | 11/2003 | Huang | |
| 6,676,069 | B1 | 1/2004 | Davis | |
| 6,739,542 | B1 | 5/2004 | Prina et al. | |
| 6,883,298 | B2 | 4/2005 | Gooding et al. | |
| 6,892,975 | B2 | 5/2005 | Chen Yu | |
| 6,905,045 | B2 | 6/2005 | Yu | |
| 6,926,225 | B1 | 8/2005 | Powers | |
| 6,997,411 | B2 | 2/2006 | Kewin | |
| 7,017,743 | B1 | 3/2006 | Patterson | |
| 7,210,649 | B2 | 5/2007 | Yu Chen | |
| 7,380,744 | B1 | 6/2008 | Yu Chen | |
| 7,401,449 | B2 | 7/2008 | Watson et al. | |
| 7,438,254 | B2 | 10/2008 | Oettershagen | |
| D593,464 | S | 6/2009 | Mentis | |
| 7,543,426 | B1 | 6/2009 | Phero | |
| 7,552,891 | B2 | 6/2009 | Huang | |
| 7,665,686 | B2 | 2/2010 | Becker et al. | |
| D612,179 | S | 3/2010 | Huang | |
| 7,726,600 | B2 | 6/2010 | Huang | |
| 7,762,490 | B1 | 7/2010 | Yu Chen | |
| 7,866,596 | B2 | 1/2011 | Yamada | |
| 7,900,421 | B2 | 3/2011 | Smith | |
| 7,937,915 | B2 | 5/2011 | Kohn et al. | |
| 8,104,705 | B2 | 1/2012 | Yu Chen | |
| 8,308,102 | B2 | 11/2012 | Lin | |
| 8,317,124 | B2 | 11/2012 | Yu Chen | |
| 8,468,778 | B2 | 6/2013 | Windheuser | |
| 8,578,683 | B2 | 11/2013 | Smith | |
| 8,616,490 | B2 | 12/2013 | Blok | |
| 8,622,332 | B2 | 1/2014 | Bologna | |
| 8,708,267 | B2 | 4/2014 | Morgan | |
| 8,783,428 | B2 | 7/2014 | Beri | |
| 9,010,675 | B2 | 4/2015 | Harrison | |
| 9,272,870 | B2 * | 3/2016 | Stanton | B65H 16/005 |
| 9,284,085 | B2 | 3/2016 | Pace | |
| 9,688,507 | B2 * | 6/2017 | Stanton | B65H 16/005 |
| 2003/0132336 | A1 | 7/2003 | Huang | |
| 2004/0065577 | A1 | 4/2004 | Yu Chen | |
| 2004/0084559 | A1 | 5/2004 | Fraser | |
| 2004/0245282 | A1 | 12/2004 | Yu Chen | |
| 2006/0032965 | A1 | 2/2006 | Yu Chen | |
| 2006/0071118 | A1 | 4/2006 | Offerhaus | |
| 2006/0175460 | A1 | 8/2006 | Hua | |
| 2006/0237577 | A1 | 10/2006 | Chen | |
| 2006/0278751 | A1 | 12/2006 | Yu Chen | |
| 2007/0063092 | A1 | 3/2007 | Zevin et al. | |
| 2007/0151208 | A1 | 7/2007 | Huang | |
| 2008/0072538 | A1 | 3/2008 | Kohn et al. | |
| 2008/0258002 | A1 | 10/2008 | Migliaccio | |
| 2009/0044494 | A1 | 2/2009 | Northrup | |
| 2009/0127372 | A1 | 5/2009 | Saraisky | |
| 2009/0308968 | A1 | 12/2009 | Piotrowski et al. | |
| 2010/0044491 | A1 | 2/2010 | Ritchey et al. | |
| 2011/0095122 | A1 | 4/2011 | Yu Chen | |
| 2011/0233321 | A1 | 9/2011 | Yu Chen | |
| 2011/0284680 | A1 | 11/2011 | Lin | |
| 2012/0153063 | A1 | 6/2012 | Furuichi | |
| 2012/0181369 | A1 | 7/2012 | Blok | |
| 2013/0152384 | A1 | 6/2013 | Yu Chen | |
| 2014/0116004 | A1 | 5/2014 | Pace | |
| 2015/0166285 | A1 | 6/2015 | Stanton | |
| 2016/0137454 | A1 | 5/2016 | Stanton | |
| 2016/0221704 | A1 | 8/2016 | Dahlmann | |
| 2016/0264277 | A1 | 9/2016 | Dahlmann | |
| 2018/0022565 | A1 | 1/2018 | Dahlmann et al. | |

FOREIGN PATENT DOCUMENTS

| | | |
|---|---|---|
| EP | 0030572 | 6/1981 |
| EP | 0227564 | 7/1987 |
| EP | 0310291 | 4/1989 |
| EP | 0499761 | 8/1992 |
| FR | 2588841 | 5/1988 |
| FR | 2910887 | 12/2009 |
| GB | 2055345 | 3/1981 |
| GB | 2289039 | 11/1995 |
| GB | 2299321 | 10/1996 |
| GB | 2456801 | 7/2009 |
| GB | 2478933 | 9/2011 |
| JP | H0769349 | 3/1995 |
| TW | 201026567 | 7/2010 |

(56) References Cited

FOREIGN PATENT DOCUMENTS

| | | |
|---|---|---|
| WO | 1993010006 | 5/1993 |
| WO | 1995000395 | 1/1995 |
| WO | 2007066194 | 6/2007 |

OTHER PUBLICATIONS

Stanton, Christopher M.; Issue Notification for U.S. Appl. No. 14/108,881, filed Dec. 17, 2013, dated Feb. 10, 2016, 1 pg.
Stanton, Christopher M.; Non-Final Office Action for U.S. Appl. No. 14/108,881, filed Dec. 17, 2013, dated Sep. 23, 2015, 29 pgs.
Stanton, Christopher M.; Notice of Allowance for U.S. Appl. No. 14/108,881, filed Dec. 17, 2013, dated Nov. 24, 2015, 5 pgs.
Stanton, Christopher M..; Non-Final Office Action for U.S. Appl. No. 15/001,281, filed Jan. 20, 2016, dated Jan. 11, 2017, 44 pgs.
Stanton, Christopher M.; Issue Notification for U.S. Appl. No. 15/001,281, filed Jan. 20, 2016, dated Jun. 7, 2017, 1 page.
Stanton, Christopher M.; Notice of Allowability for U.S. Appl. No. 15/001,281, filed Jan. 20, 2016, dated Apr. 26, 2017, 6 pgs.
Stanton, Christopher M.; Notice of Allowance for U.S. Appl. No. 15/001,281, filed Jan. 20, 2016, dated Mar. 8, 2017, 5 pgs.
Dahlmann, Deborah A.; Advisory Action for U.S. Appl. No. 14/609,567, filed Jan. 30, 2015, dated Jan. 24, 2017, 4 pgs.
Dahlmann, Deborah A.; Final Office Action for U.S Appl. No. 14/609,567, filed Jan. 30, 2015, dated Oct. 20, 2016; 11 pgs.
Dahlmann, Deborah A.; Non-Final Office Action for U.S. Appl. No. 14/609,567, filed Jan. 30, 2015, dated Jun. 16, 2016, 38 pgs.
"Hand Savers Stretch Wrap Film Hand Dispenser" www.ebay.com http://www.ebay.com/itm/Hand-Savers-Stretch-Wrap-Film-Hand-Dispenser-1-set-/251286375179 (Accessed Jun. 10, 2013), 3 pgs.
"Stretch film—BK Holder" www.benkaico.com http://www.benkaico.com/product-area/stretch-film---k-holder (Accessed Jun. 10, 2013), 2 pgs.
"Stretch Film Dispenser—Hand Core Insert 3" www.aaabalingandstrapping.com http://www.aaabalingandstrapping.com/index.php?main_page=product_info&cPath=8&products_id=183&zenid=3tkfdrfajbi8ha9ducbdvfclv4 (Accessed Jun. 10, 2013), 2 pgs.
Goodwrappers; "Unitization products by Goodwrappers, include hand wrappers, replacement rolls, core handwrap, generic and disposable hand wrap", Apr. 7, 2010, located at <https://web.archive.org/web/20100407080537/http:/www.goodwrappers.com/prod_unit.asp>, 2 pgs.
Images of Braking Wrap Film Dispenser, the Dispenser publicly available prior to Dec. 17, 2012, 12 pgs.
Vestil Manufacturing; "Stretch Wrap Dispensers", located at <http://www.vestilmfg.com/products/mhequip/stretch_wrap_dispensers.htm>, Copyright 2014, accessed on Aug. 11, 2014, 2 pgs.
Dahlmann, Deborah A.; Non-Final Office Action for U.S. Appl. No. 14/642,940, filed Mar. 10, 2015, dated Oct. 11, 2017, 48 pgs.
Dahlmann, Deborah A.; Issue Notification for U.S. Appl. No. 14/609,567, filed Jan. 30, 2015, dated Feb. 14, 2018, 1 pg.

* cited by examiner

BRAKING WRAP DISPENSER

REFERENCE TO RELATED APPLICATIONS

This application is a continuation of U.S. application Ser. No. 15/001,281, filed Jan. 20, 2016, which is a continuation of U.S. application Ser. No. 14/108,881, filed Dec. 17, 2013, which issued into U.S. Pat. No. 9,272,870 on Mar. 1, 2016, all of which are hereby specifically incorporated by reference herein in their entireties.

FIELD

This disclosure relates to film wrap dispensers. More specifically, this disclosure relates to braking wrap dispensers that allow the rolls of polymeric sheets or films to be dispensed in an ergonomic manner and increase tension in the film as it is being dispensed.

BACKGROUND

Like cellophane, which is commonly rolled up on a cardboard core member and used a moisture-proof wrapping for food by unrolling the material onto food found on a plate or other dish, other types of plastic or other sheets of material are sometimes used to wrap goods. For example, this plastic film, membrane, or sheet of any suitable material is often rolled up on cylindrical cardboard core or other similar device such as a spool made of another material that allows the film or sheet to be dispensed to facilitate the wrapping of goods. This can protect the goods from dust, water, and other contaminants found in their environment. In many situations, this dispensing is done manually. Accordingly, it is desirable that the method of dispensing the film or sheet is done in a safe and ergonomic manner.

SUMMARY

Disclosed is a film dispenser which includes a holding member and a rotating member.

The holding member includes a first end and a second end and defines a longitudinal axis that extends from the first end to the second end. The holding member further includes a brake portion defined on the second end of the holding member, the brake portion includes a width and a length. The holding member further includes a connecting portion that extends radially inward from the brake portion. The second end of the holding member defines a slot which includes a first portion extending across the width of the brake portion and a second portion and a third portion that extends across the length of the brake portion. The first portion and the second portion of the slot are distal from each other on opposing sides of the brake portion. The rotating member includes a first end and a second end. The rotating member defines an axis of rotation that extends from the first end to the second end. The longitudinal axis of the holding member is aligned with the axis of rotation of the rotating member.

Also disclosed is a method of braking a film dispenser. The method includes the steps of holding the film dispenser by gripping an interior holding surface and an exterior holding surface of a holding member of the film dispenser, the holding member including a first end, a second end, and a brake portion, and the holding member defining a longitudinal axis that extends from the first end to the second of the holding member. The method further includes the steps of dispensing film from the film dispenser by rotating a rotating member of the film dispenser about the second end of the holding member. The rotating member is defining an axis of rotation that extends from the first end to the second end of the rotating member, and the longitudinal axis of the holding member is aligned with the axis of rotation of the rotating member. The method further includes the steps of braking the film dispenser by pressing the brake portion of the holding member to engage the brake portion with the rotating member to increase a tension in the film being dispensed, the brake portion comprising a width and a length. The brake portion is defined on the second end of the holding member by a slot including a first portion extending across the width of the brake portion and a second portion and a third portion extending across the length of the brake portion. The first portion and the second portion of the slot are distal from each other on opposing sides of the brake portion.

Also disclosed is a film dispenser comprising a holding member, the holding member comprising: a first end; and a second end joined to the first end, the holding member defining a longitudinal axis extending from the first end to the second end, the second end defining: a brake portion comprising a width measured in a direction perpendicular to the longitudinal axis and a length measured in a direction parallel to the longitudinal axis; a connecting portion extending radially inward from the brake portion; and a slot defined in the brake portion, the slot comprising a first portion extending in a circumferential direction across the width of the brake portion and a second portion and a third portion extending across the length of the brake portion, the second portion and the third portion distal from each other on opposing sides of the brake portion, the slot further comprising a fourth portion angled with respect to the second portion and a fifth portion angled with respect to the third portion, the fourth portion and the fifth portion extending in a circumferential direction, the fourth portion of the slot intersecting the second portion of the slot and the fifth portion of the slot intersecting the third portion of the slot.

Also disclosed is a method of braking a film dispenser, the method comprising: holding the film dispenser by gripping an interior holding surface and an exterior holding surface of a holding member of the film dispenser, the holding member comprising a first end, a second end, and a brake portion, the holding member defining a longitudinal axis that extends from the first end to the second of the holding member; dispensing film from a film roll of the film dispenser by rotating the film roll about the second end of the holding member, the longitudinal axis of the holding member aligned with an axis of rotation of the film roll; and braking the film dispenser by pressing the brake portion of the holding member to at least indirectly engage the brake portion with the film roll to increase a tension in the film being dispensed, the brake portion comprising a width and a length, the brake portion defined in the second end of the holding member by a slot, the slot comprising a first portion extending in a circumferential direction across the width of the brake portion and a second portion and a third portion extending across the length of the brake portion, the first portion and the second portion of the slot distal from each other on opposing sides of the brake portion, the slot further comprising a fourth portion and a fifth portion extending in a circumferential direction, the fourth portion of the slot intersecting the second portion of the slot and the fifth portion of the slot intersecting the third portion of the slot.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

DESCRIPTION OF THE FIGURES

The features and components of the following figures are illustrated to emphasize the general principles of the present disclosure and are not necessarily drawn to scale. Corresponding features and components throughout the figures may be designated by matching reference characters for the sake of consistency and clarity.

DETAILED DESCRIPTION

Disclosed is a film or wrap dispenser and associated methods, systems, devices, and various apparatus. The dispenser includes at least one holding member and one rotating member that are joined in a rotatable fashion so that the rotating member may rotate with a spool of wrap or film while the user comfortable holds the holding member. The terms "holding member" and "rotating member" should be interpreted broadly and should be applied to any member that accomplishes the necessary tasks of, respectively, holding the dispenser in a user's hand and allowing the rotating member to rotate with the spool as long as the longitudinal axis of the holding member is coextensive or aligned, or nearly so, with the axis of rotation of the rotating member. While it is particularly useful in applications for dispensing plastic film, sheets, or wrap, it should not be so limited as it could be used with other materials of any desired thickness that is used to enclose, enwrap, or otherwise protect articles. It would be understood by one of skill in the art that the disclosed dispenser is described in but a few exemplary embodiments among many. No particular terminology or description should be considered on the disclosure or the scope of any claims issuing therefrom.

Figure 1:
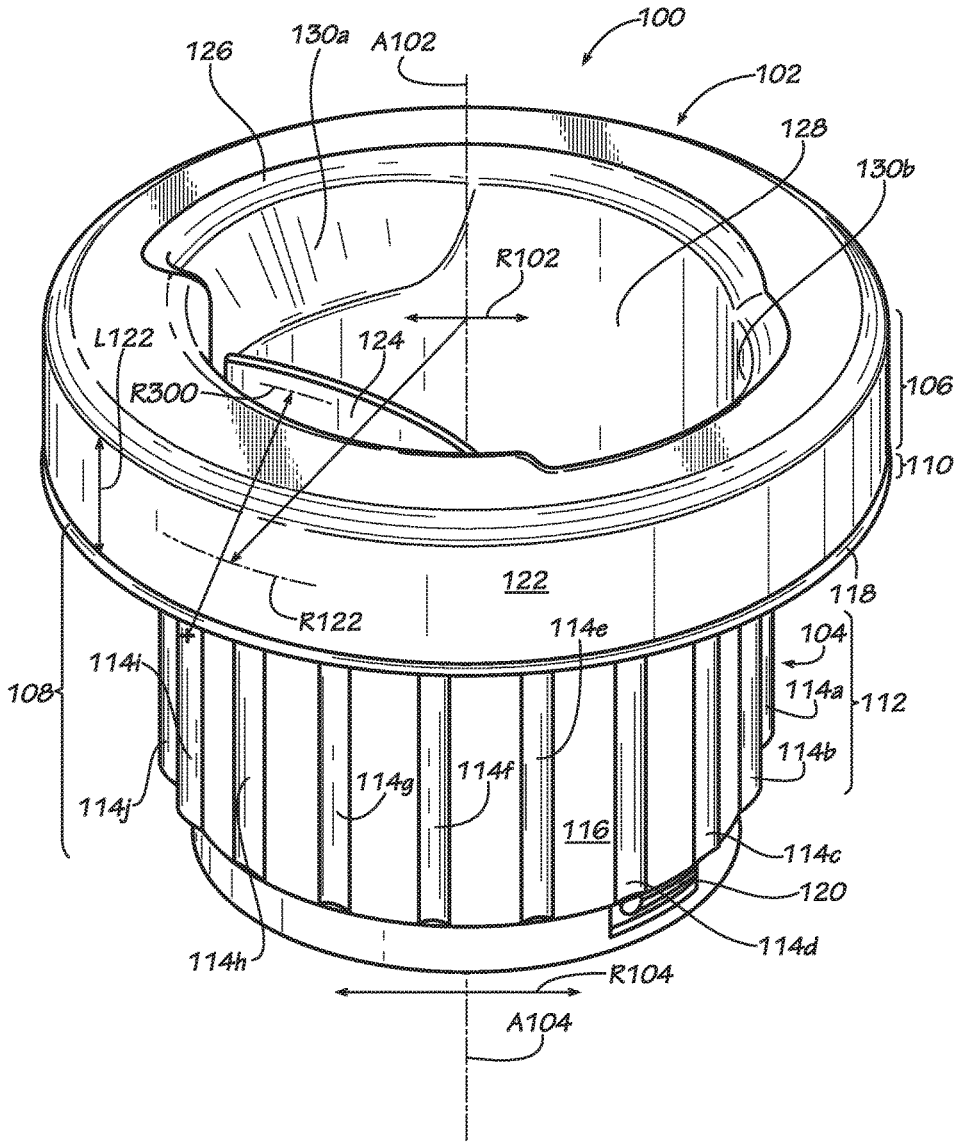
FIG. 1 is perspective view of a film dispenser according to a first embodiment of the present disclosure including a holding member and a rotating member.
Figure 2:
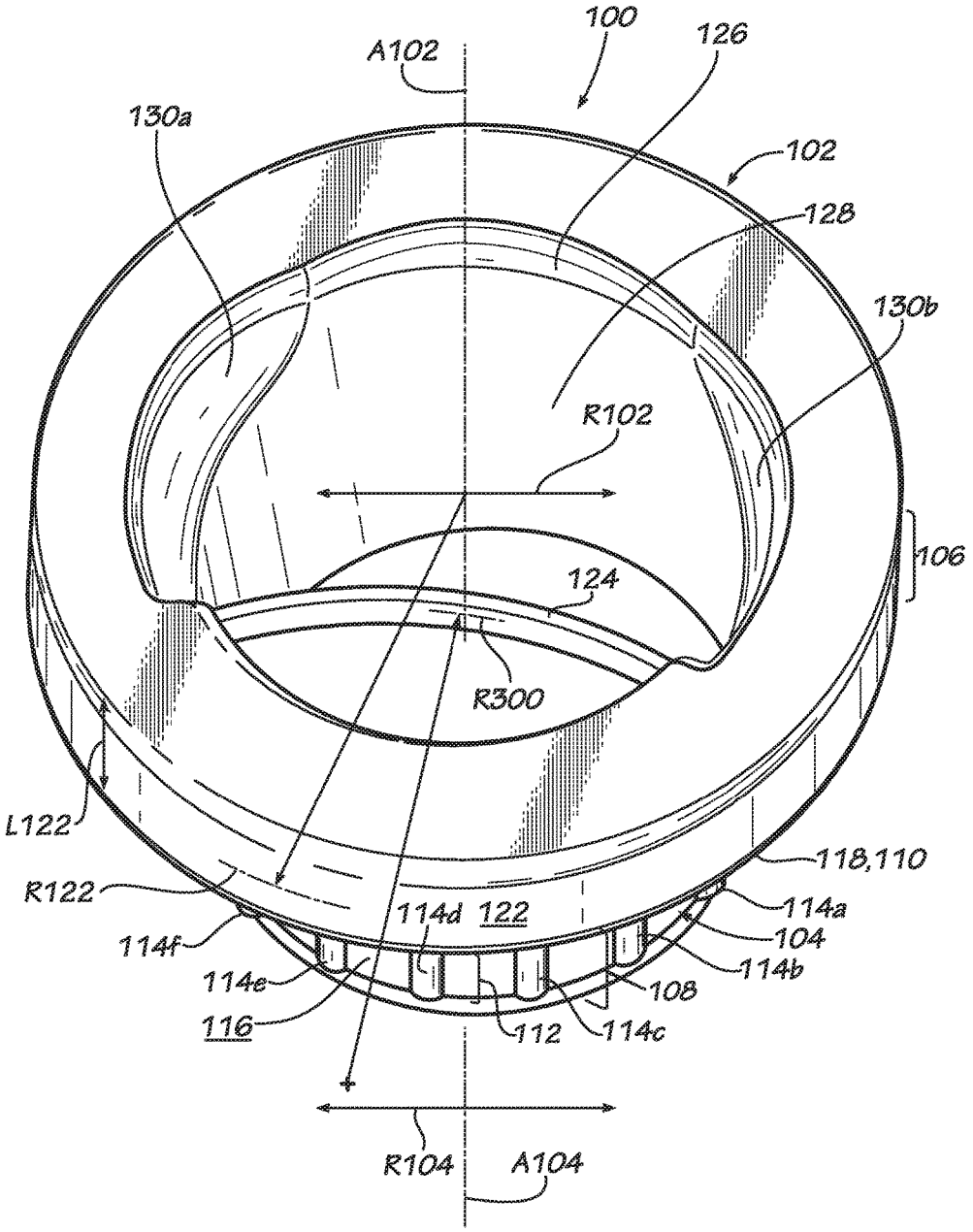
FIG. 2 is an alternate perspective view of the film dispenser of FIG. 1.

One embodiment of a film dispenser 100 is shown and described in FIGS. 1 and 2. The film dispenser 100 comprises a holding member 102 and a rotating member 104 of substantially annular or tubular configuration that are separate components. Consequently, the holding member 102 has a longitudinal axis A102 that extends from its first end 106 to its second end 108 and also has a radial direction R102. The rotating member 104 comprises a tubular sleeve that has an axis of rotation A104 that extends from its first end 110 to its second end 112 with ridges or ribs 114*a* thru 114*j* (only ten are shown but there are eighteen in total that are evenly spaced around the periphery, though any number of ribs 114 may be present in various embodiments including a single rib or a plurality of ribs that may or may not be evenly placed about the periphery of the rotating member) on its outside, exterior, or peripheral surface 116 of its second end 112 for engaging the inside surface of a spool or hollow cardboard core of wrap or other film (shown most clearly in FIG. 10) and an annular flange 118 that contacts the holding member 102 at its first end 106 or nearly so. The flange may have a thickness along the axis of rotation and may extend annularly in a direction that is perpendicular to the axis of rotation. The rotating member 104 is thus trapped between a snap 120 of the holding member 102 and the umbrella or mushroom-shaped top portion of the first end 106 of the holding member 102, allowing it to rotate freely but not move along the longitudinal axis A102 of the holding member 102. The rotating member 104 also has a radial direction R104. When assembled as shown, the rotating axis A104 of the rotating member 104 and the longitudinal axis A102 of the holding member 102 are aligned or coextensive, or nearly so, allowing the user to hold onto the holding member 102 while the spool of wrap and the rotating member 104 turn, allowing the wrap to be dispensed. It should be noted that some clearance is provided between the holding member 102 and the rotating member 104 in both the radial and longitudinal directions so that that the rotating member can freely rotate. In some embodiments, the amount of clearance can range from 0.005 to 0.025 of an inch on a side.

The umbrella or mushroom shaped portion of the first end 106 of the holding member 102 has an exterior holding surface 122 that can be clearly seen in FIGS. 1 and 2 and an interior holding surface 300 that is on the back side of a rail 124 that is not clearly seen in these figures. However, this surface 300 can be clearly seen in FIG. 3. It is intended that a portion of the palm of the hand as well as a portion of the thumb be placed against the exterior holding surface 122 while the interior of the fingers can be placed onto the interior holding surface 300. Thus, the holding member 102 provides an ergonomic handle for a user to hold as the film dispenser is used to dispense material. The holding member 102 also has a brake portion 302 (not shown in FIGS. 1 and 2 but shown in FIG. 3), which is operatively associated with the rail 124 and interior holding surface 300 so that if sufficient force is exerted by the fingers of a user, the brake portion 302 is deflected outwardly along the radial direction R102 of the holding member 102 and contacts the rotating member 104, creating enough friction to stop or at least retard the rotation of the rotating member 104. This, in turn, causes any wrap or film being dispensed to be tensed and in some circumstances, stretched a desired amount. When these effects are no longer desired, the user simply releases the brake portion 302 by removing enough force from the rail 124 and interior holding surface 300 so that the brake portion 302 springs back inwardly along the radial direction R102 of the holding member 102 and no longer contacts the rotating member 104. Although the operative association between the rotating member 104 and the brake portion 302 may be direct, such as when the brake portion 302 is able to engage the rotating member 104 directly or contact it directly, the operative association may also be indirect as may be the case when other components are found between the brake portion 302 and the rotating member 104.

As shown in FIGS. 1 and 2, the first end 106 of the holding member 102 includes a blend 126 that extends along the full circumference of a central hole 128 of the holding member 102 that helps provide a lead-in as a user inserts a hand into this hole 128 for grasping onto the holding member 102. Similarly, two chamfered regions 130*a*, 130*b* are provided diametrically opposite each other near where the forefinger and pinky finger of a user are inserted into the hole 128, helping the hand of the user find its way comfortably into the hole. Likewise, the exterior holding surface 122 of the holding member 102 is curved has a radius of curvature R122 that is concentric with the longitudinal axis A102 of the holding member 102, and is therefore concentric with the axis of rotation A104 of the rotating member 104 or nearly so once the holding member 102 is inserted into the rotating member 104 and the two components are rotatably attached. This construction advantageously reduces the amount of torque exerted on the hand of the user as wrap is dispensed, providing an ergonomic feel during use of the apparatus. Also, the exterior holding surface 122 is of sufficient length L122 along the longitudinal axis A102 of the holding member 102 that the rotating roll and its sheet are spaced away from the hand a sufficient distance, helping to protect the hand from the sheet or film as it moves during dispensing. In some embodiments, this distance is as much as 0.75 inches or more but it is contemplated that this distance could be less as long as it is at least greater than 0.250 of an inch for reasons explained later herein. In some embodiments, this distance is equal to the length L122 of the holding surface 122, but it is contemplated that the distance could be split into a portion that includes the length L122 of the holding surface 122 and another distance that separates the first portion 106 of the holding member 102 from the first portion 110 of the rotating member 104 as would be the case if another stop member or flange was added to the holding member and spaced therefrom along the longitudinal axis for contacting the annular flange of the rotating member.

Figure 3:
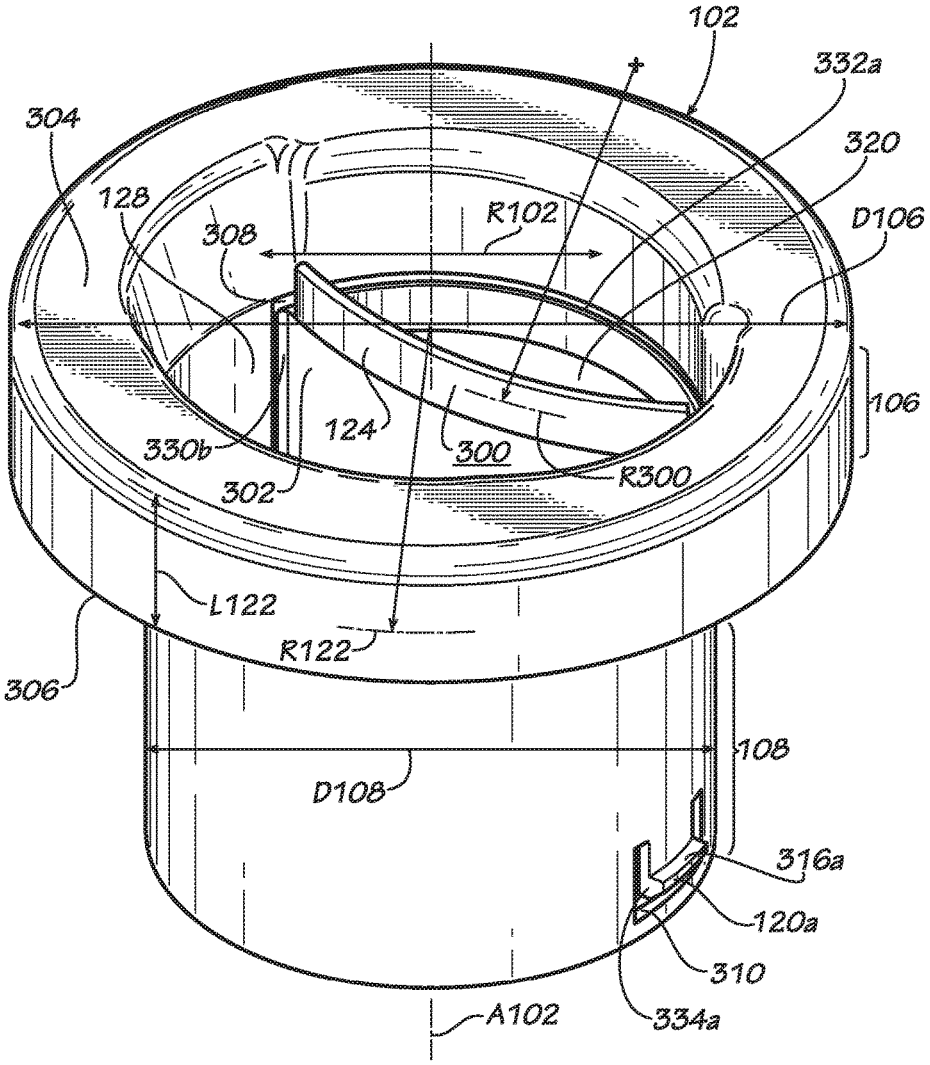
FIG. 3 is a perspective view of the holding member of the film dispenser of FIG. 1 shown by itself.
Figure 4:
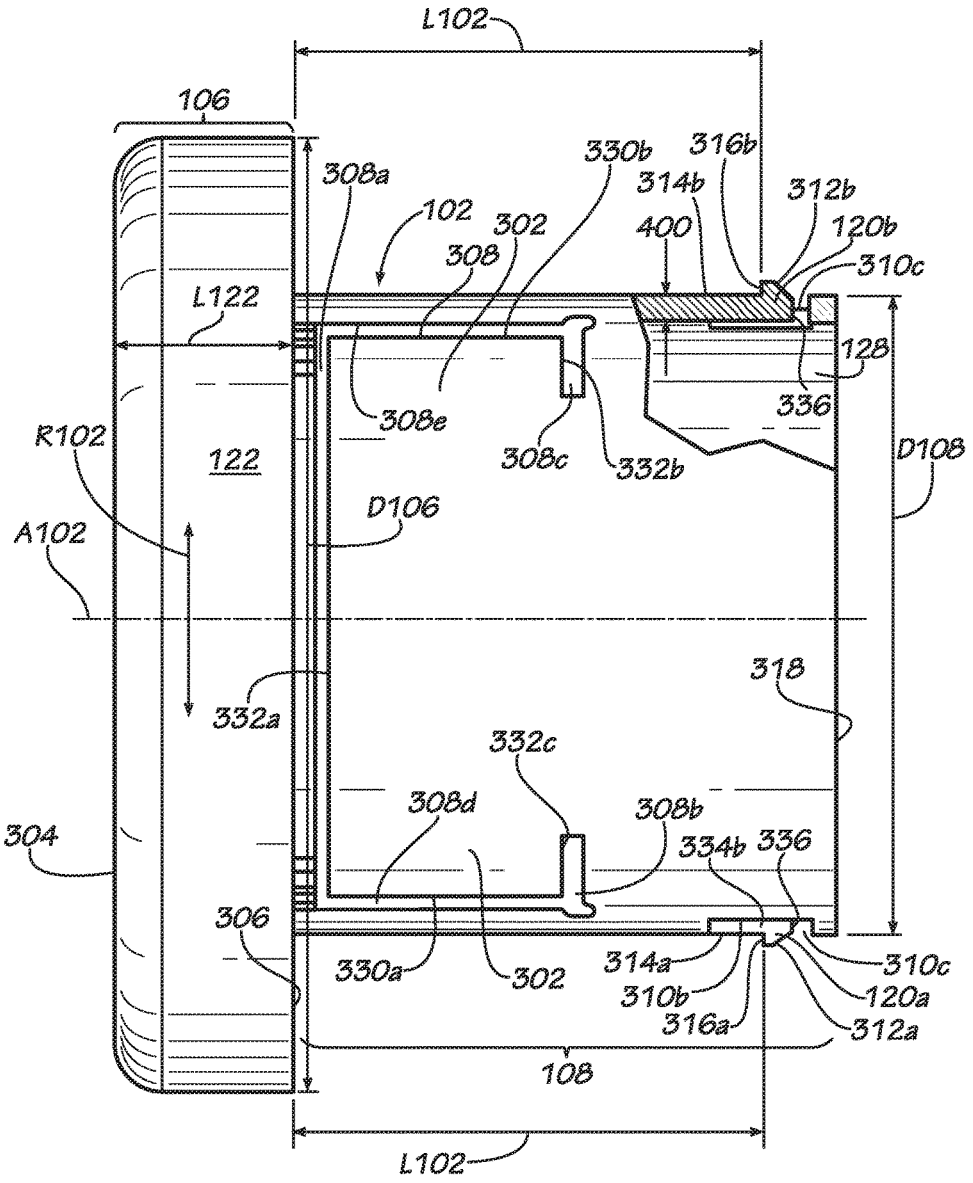
FIG. 4 is a partial cross-sectional side view of the holding member of FIG. 3 illustrating more clearly its brake portion.
Figure 5:
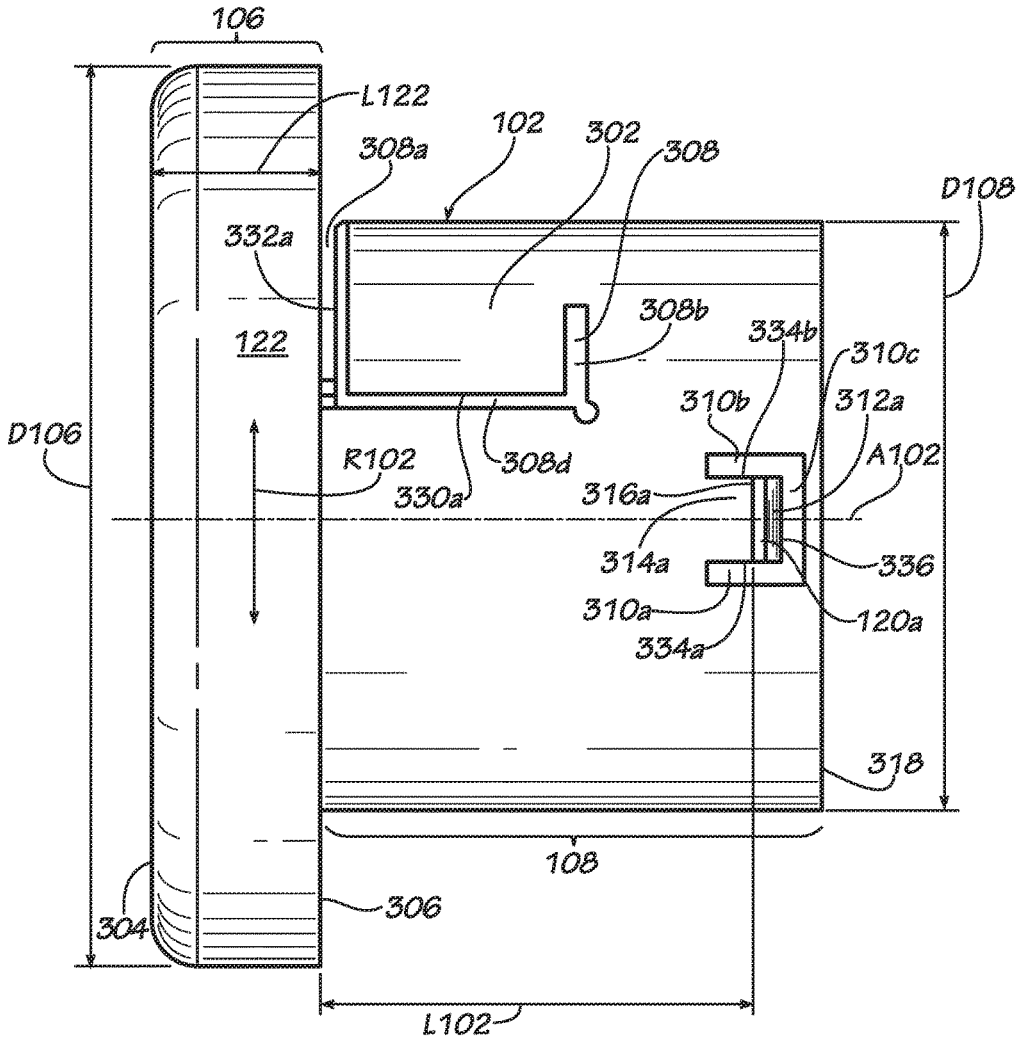
FIG. 5 is an alternate side view of the holding member of FIG. 3 showing clearly a snap.

Focusing now on FIGS. 3, 4, and 5, the details of the structure of the holding member 102 can be seen. As mentioned already, the holding member 102 includes a first end 106, a second end 108, and a longitudinal axis A102 that extends from the first end 106 to the second end 108. The first end 106 is configured for being held in a hand of a user as previously described above and the second end 108 is tubular and is configured for engaging the rotating member 104. The first end 106 includes an outside extremity 304 or surface that defines the portion of the first end 106 of the holding member 102 that is furthest away from the interior of the holding member 102 along the longitudinal axis A102. This extremity 304 is spaced away from an inside extremity 306 or surface, which defines the portion of the first end 106 of the holding member 102 that is nearest the second end 108 of the holding member 102, by a predetermined distance L122. The first end 106 of the holding member 102 has an outside diameter D106 and the second end 108 of the holding member 102 has an outside diameter D108.

Looking at FIG. 4, it can be seen that the holding member 102 has a nominal or typical wall 400 that has a thickness that varies within prescribed ranges. In some embodiments, this wall can vary in thickness from 0.045 to 0.085 inches but may average around 0.065 inches. Of course, the thickness of the nominal wall 400 may vary outside of this range or may not exist at all if the holding member 102 and the rotating member 104 are machined from a single piece of material. That is to say, maintaining a consistent wall thickness in such situations is not necessary and may not be present for that reason. For example, the holding member 102 and the rotating member 104 have a nominal wall that maintains a consistent wall thickness since they are made from plastic using an injection molding process. In such a case, it is advantageous to maintain a nominal wall having a fairly consistent wall thickness to avoid processing defects such as sink marks or voids. The general design rule is that the variation in the wall thickness of an injection molded part should be between +/−15% to +/−25% depending on the shrinkage factor of the material. However, it is contemplated that these components may be made of other suitable materials using other suitable processes, in which case the maintenance of a nominal wall thickness is not necessary. However, in cases where a nominal wall having a relatively consistent wall thickness is provided for either the holding member 102 or the rotating member 104, it is preferable that the outside extremity of the holding member be spaced away from the inside extremity of the first end of the holding member by an amount greater than a nominal wall thickness. In some embodiments, this amount may be at least greater than 0.250 inches.

Figure 11A:
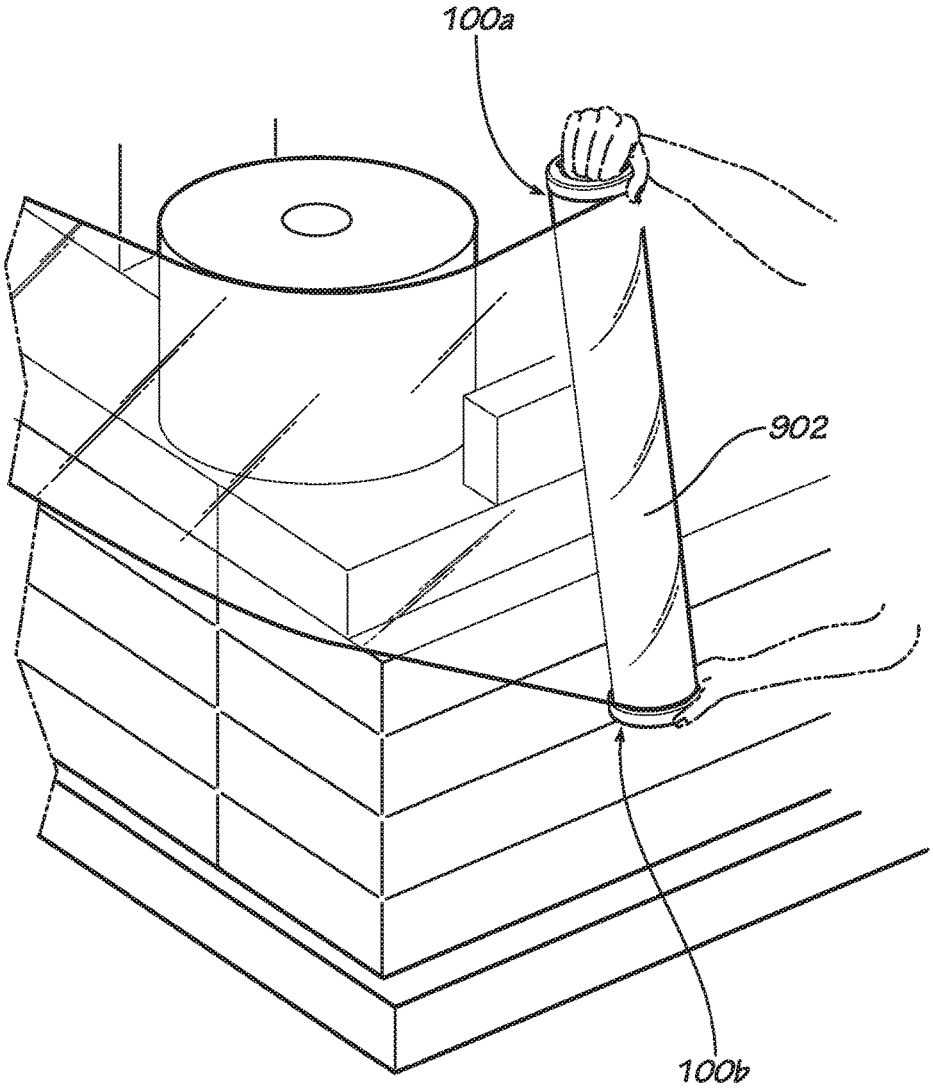
FIG. 11A is an aerial view of a spool with two dispensers attached to the spool at either end in a manner consistent with FIGS. 9 and 10.
Figure 11B:
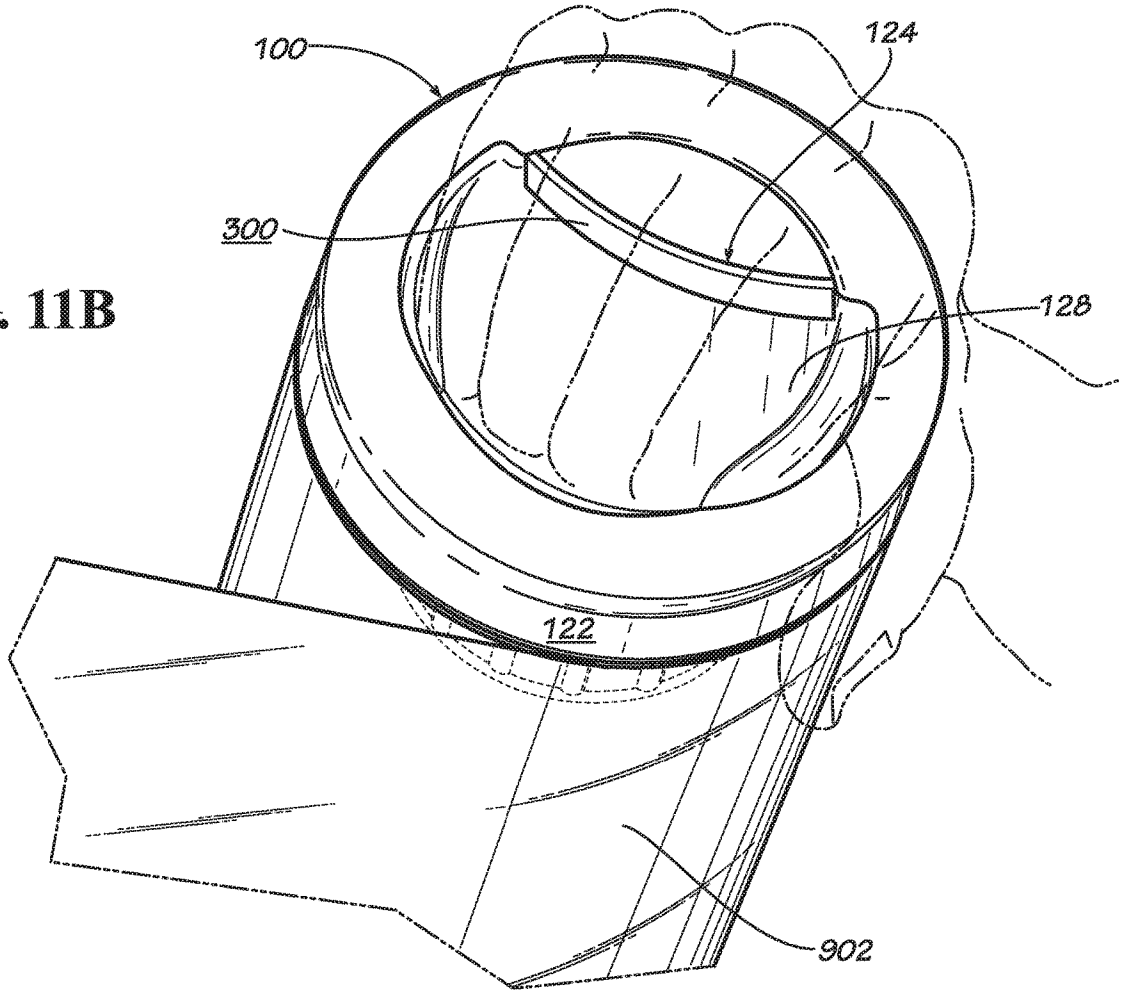
FIG. 11B is an enlarged view of a dispenser and spool of FIG. 11A depicting how a dispenser is held in the hand of the user.

Also, the exterior holding surface 122 of the first end 106 of the holding member 102 may extend from the outside extremity 304 to the inside extremity 306 of the first end 106 of the holding member 102 in a continuous fashion, providing a smooth and consistent surface for placing a portion of the palm of the hand or thumb on the surface (depicted in FIGS. 11A and 11B). As shown in FIGS. 1 thru 3, the exterior holding surface 122 is curved and has a radius of curvature R122 that has a center that is coextensive with the longitudinal axis A102 of the holding member, meaning that it is concentric with the longitudinal axis. As shown in FIGS. 1 thru 3, the exterior holding surface 122 is found on an umbrella or mushroom shaped first end 106 of the holding member 102 and is substantially smooth in the circumferential and longitudinal directions. However, it is contemplated that this shape could be altered and that the exterior holding surface 122 does not necessarily need to be straight. For example, the exterior holding surface 122 could be wavy or could have something other than a purely radial configuration when looking at the top of the holding member 102. In such a case, as long as the average location of the exterior holding surface would be close or equivalent to a radius of curvature with a center that is close or coincident with the longitudinal axis of the holding member, than the advantage of reduced torque on the hand of a user during use of the apparatus would be achieved. Accordingly, these other embodiments are contemplated to be within the scope of the present disclosure.

The brake portion 302 of the holding member 102 can be seen completely in FIG. 4 and partially in FIGS. 3 and 5. It is formed by a cutout in the wall of the second end 108 of the holding member 102 that is defined by a slot 308, that is to say, the slot is in the vicinity of the brake portion and the connection portion that extends from the brake portion in a manner that will be described later herein. The slot has three portions 308*a*, 308*b*, 308*c* that extend in the radial direction R102 of the holding member 102 from the inside surface that defines hole 128 of the holding member 102 toward the outside surface that defines the outer diameter D108 of the holding member 102, which is in a plane that is perpendicular to the longitudinal direction A102 of the holding member 102. Alternatively, one may characterize these slots as extending in the circumferential direction around the holding member 102. The first 308*a* of these radial slot portions defines the topmost extent of the brake portion 302 and is at, proximate, or near the intersection of the first and second ends 106, 108 of the holding member 102 and extends completely across and above the brake portion 302. Portion 308*a* is located toward or nearer the exterior of the holding member along the longitudinal axis A102. On the other hand, the second and third of these radial slot portions 308*b*, 308*c* are located toward or nearer the interior of the holding member along the longitudinal axis. The second and third of these radial slot portions 308*b*, 308*c* extend only partially across the brake portion 302 on either side of the brake portion 302 near or proximate where the brake portion connects to the wall of the second end 108 of the holding member 102. The slot 308 also has two longitudinal slot portions 308*d*, 308*e* that extend in the longitudinal direction A102 and connect the first radial slot portion 308*a* with the second and third radial slot portions 308*b*, 308*c*, respectively. The slot 308 provides the brake portion with enough flexibility so that it can move and contact the rotating member 104 when it is desired to tense the sheet or film being unrolled by the dispenser 100. In other words, the brake portion 302 is thus configured for engaging the rotating member 104. To this end, the slots have a width that can vary from 0.05 to 0.125 of an inch but widths outside of this range are also contemplated depending on the application. Therefore, these other embodiments are considered part of the present disclosure as well. Of course, as best seen in FIG. 4, the slot 308 defines two longitudinal extending exterior surfaces 330*a*, 330*b* and three radial extending exterior surfaces 332*a*, 332*b*, 332*c* of the brake portion 302.

One snap 120*a* can be completely seen in FIGS. 3 and 5 while both snaps 120*a*, 120*b* can be partially seen in FIG. 4 as they are diametrically opposite each other and are found below the chamfered regions 130*a*, 130*b* found on the first end 106 of the holding member 102 along the longitudinal axis A102. The snap 120*a* is defined by another slot 310 that has two longitudinal portions 310*a*, 310*b* and one radial or circumferential portion 310*c* (as best seen in FIG. 5) since it extends in a direction or plane that is perpendicular to the longitudinal axis A102 of the holding member 102. The slots 310 thus configures the snaps 120*a*, 120*b* with enough flexibility so that they can move inward along the radial direction R102 of the holding member 102 as the second end 108 of the holding member 102 is inserted into the rotating member 104. To this end the width of these slots is 0.050 to 0.0125 of an inch but could be varied as needed and these other embodiments are considered to be within the scope of the present disclosure. These slots define two longitudinally extending exterior surfaces 334*a*, 334*b* and one radially oriented exterior extending surface 336. Each snap 120*a*, 120*b* has a ramp surface 312*a*, 312*b* angled at 40 degrees from the longitudinal direction A102 to provide a camming motion to the snap 120*a*, 120*b* as it is inserted into rotating member 104 until the outside circumferential surface 314*a*, 314*b* of the snap 120*a*, 120*b* will contact the inside surface of the rotating member 104. A relatively flat catch surface 316*a*, 316*b* is found on the snap 120*a*, 120*b* that faces in a direction toward the inside of the holding member 102 along the longitudinal axis A102. The snaps 120*a*, 120*b* are found near or proximate an outside extremity 318 of the second end 108 of the holding member 102. As mentioned above and will be shown in more detail later herein, the overall length of the rotating member 104 is less than the distance from the first end 106 of the holding member 102 to the catch surface 316 of the snap 120 measured in a direction that is parallel to the longitudinal axis A102 of the holding member 102, allowing it to be placed between these features so it abuts these features. It is contemplated that the number, placement, and configuration of the snaps may be altered in various embodiments and within particular embodiments of the present disclosure. For example, a plurality of snaps or a single snap may be used as well as other variations.

Figure 8:
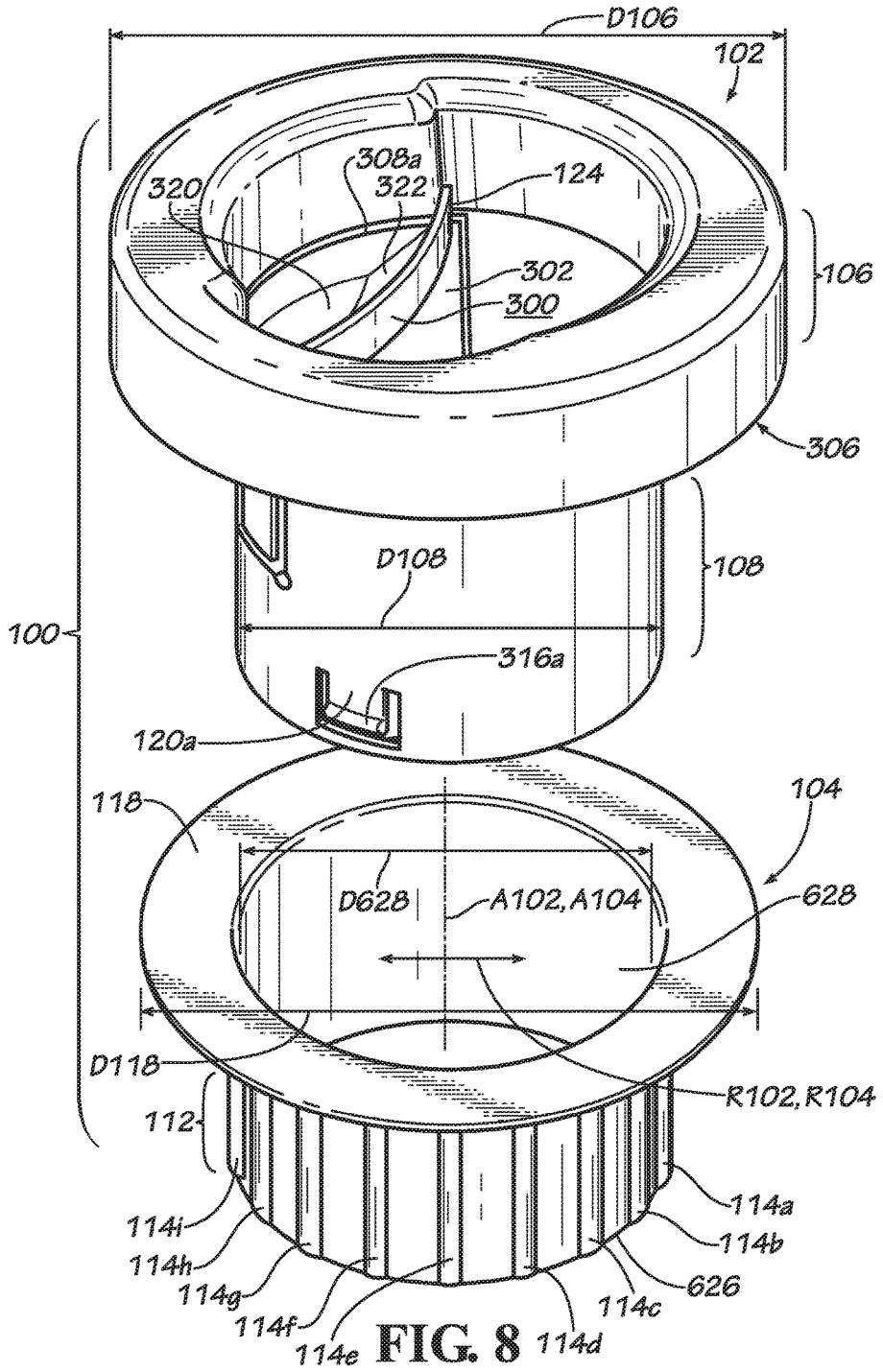
FIG. 8 is a top oriented exploded assembly view of the film dispenser of FIG. 1 showing how the holding member and rotating member are assembled.

As mentioned above with respect to FIGS. 1, 2, and 3, the first end 106 of the holding member 102 includes a blend 126 and chamfers 130 for guiding the insertion of a hand into the central hole 128 of the holding member 102. Once a hand is inside of the holding member 102, it presses onto the interior holding surface 300 found on the rail 124 that is operatively associated with the brake portion 302 of the holding member 102. An example of how this operative association is made in one embodiment of the present disclosure will now be explained with reference to FIGS. 3 and 8. As already stated, the top radial portion of the slot 308*a* that defines the brake portion 302 is found at the division of the holding member 102 into its first and second ends 106, 108 (see FIG. 4). Therefore, any structure found above this top radial portion of the slot 308*a* is to be considered part of the first end 106 of the holding member 102. A connecting portion 320 is located toward the interior of the holding member 102 along the longitudinal axis A102 and away from the outside extremity of the first end of the holding member 102, said connecting portion 320 extends in a plane that is perpendicular to the longitudinal axis A102 of the holding member 102. Also, the connecting portion 320 or member is located below the top radial portion of the slot 308*a* and extends in an inner radial direction R102 toward the rail 124, which extends above the top radial portion of the slot 308*a*. A transition region 322, member, or portion connects or attaches the connecting portion 320 to the rail 124 and its associated interior holding surface 300 and angles upwardly along the longitudinal direction A102 to the connecting portion 320 as best seen in FIG. 8.

Accordingly, the rail 124 and interior holding surface 300 are considered part of the first end 106 of the holding member 102, even though they are not connected directly to the first end 106 of the holding member 102, while the connecting and transition portions 320, 322 are considered to be part of the second end 108 of the holding member 102. Since the rail 124 and its interior holding surface 300 are connected to the brake portion 302 by the transition and connecting portions 320, 322 of the second end 108 of the holding member 102, the rail 124 and its interior holding surface 300 are operatively associated with the brake portion 302 as any force directed in an outward direction along the radius R102 of the holding member 102 will necessarily move the brake portion 302. Of course, it is contemplated that this operative association could be achieved in other ways such as by having the rail connected to the brake portion directly. Also, the rail 124 and the interior holding surface 300 may all be found on the second end 108 of the holding member 102 as would be the case if they were found below the top radial portion of the slot 308*a* that defines the brake portion 302. The interior holding surface 300 also has a radius of curvature R300 that has a center that is found toward the exterior of the holding member and is therefore not coincident or concentric with the longitudinal axis A102 of the holding member.

The slots 308, 310 that define the brake portion 302 and the snaps 120 create undercuts when molding or casting is used to make the holding member 102. As a result, a side action or side actions may be used to form these structures as the holding member 102 is being molded that are then removed, eliminating the undercut and allowing the ejection of the holding member 102 from the mold. For example, two side actions that each make one snap and half of the slots that define the brake portion may be employed. With such a design, the side actions would move in a direction that is perpendicular to the longitudinal axis A102 and runs up and down as shown in FIG. 4, which is parallel to the radial direction R102, or that is perpendicular to the page in FIG. 5.

Figure 6:
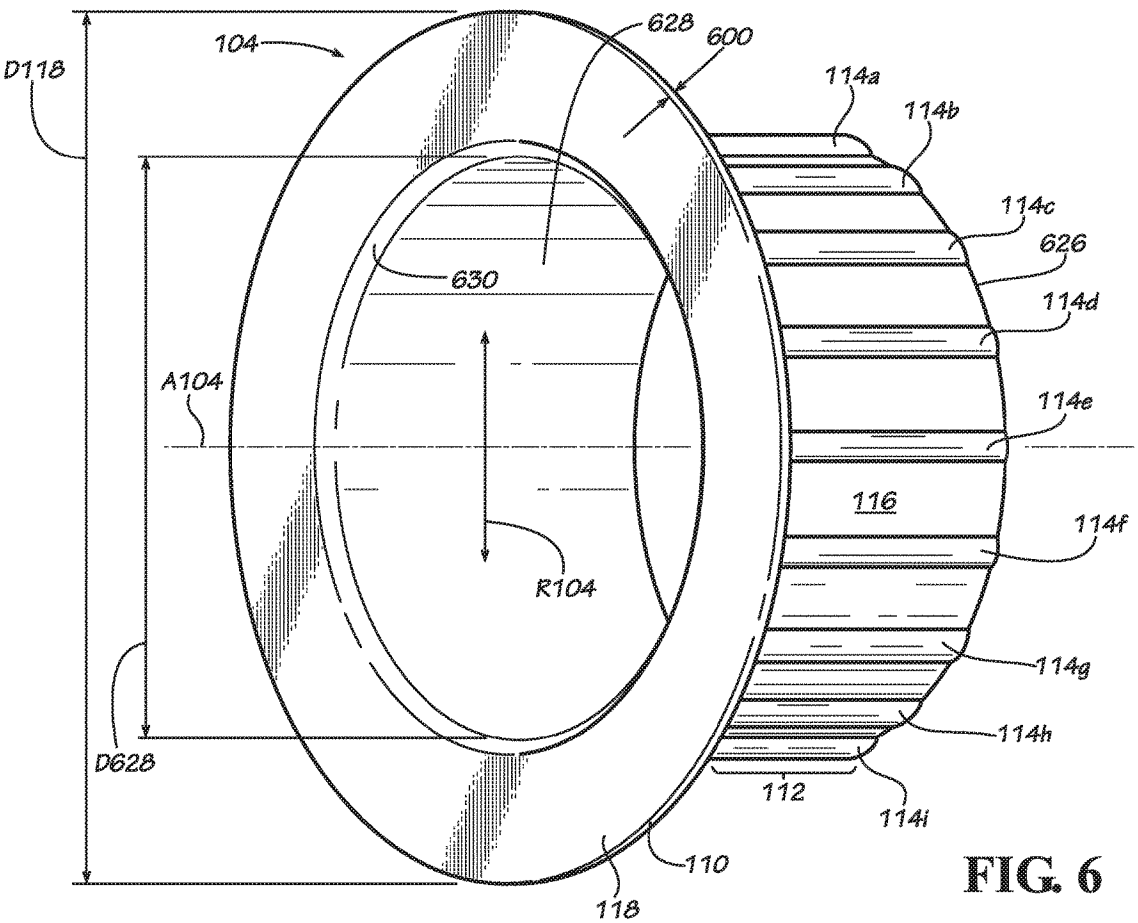
FIG. 6 perspective view of the rotating member of the film dispenser of FIG. 1 shown by itself.
Figure 7:
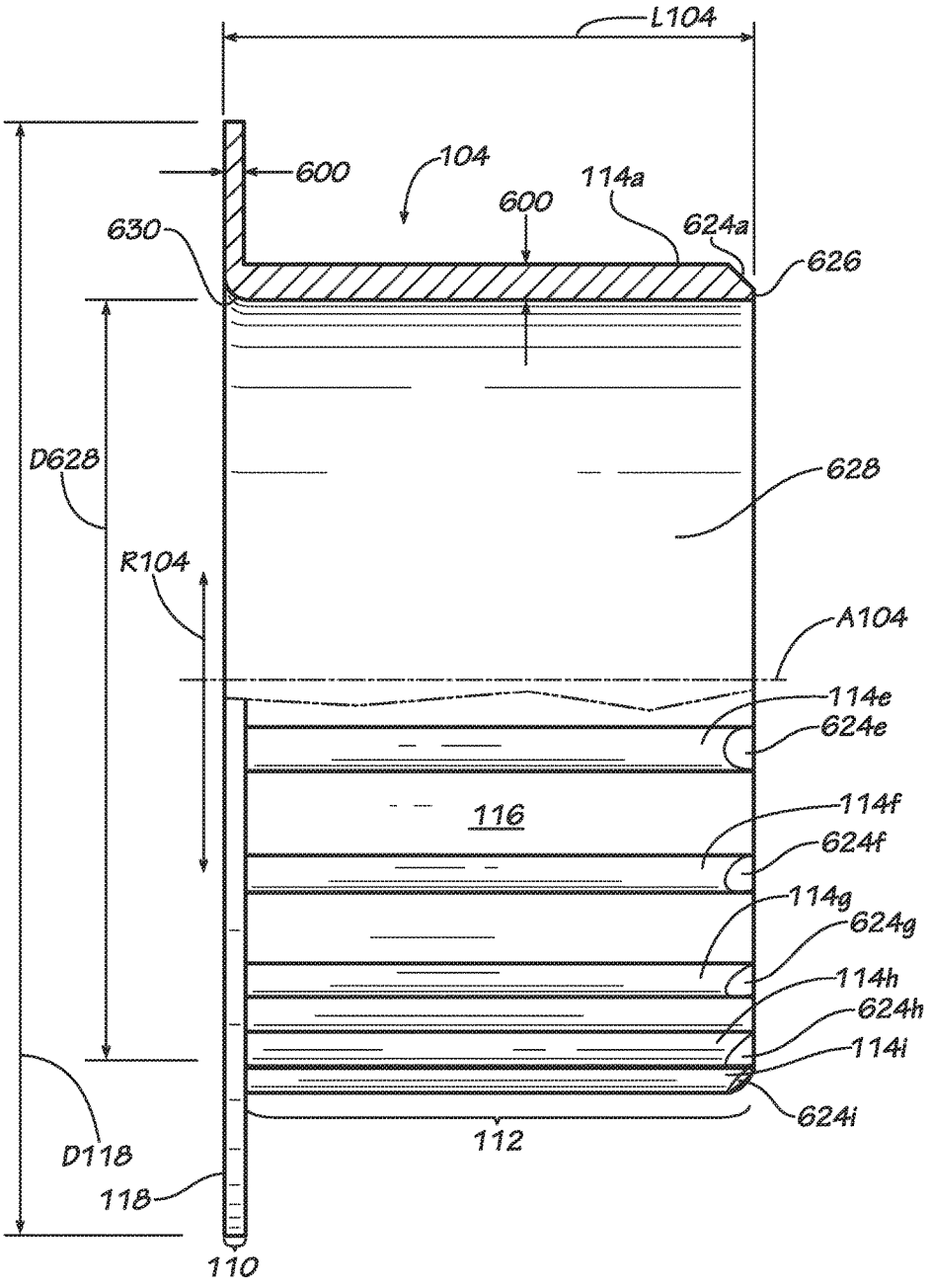
FIG. 7 is a side view of the rotating member of FIG. 6 shown in a partial cross-sectional view to show the variance of the nominal or typical wall of the rotating member.

FIGS. 6 and 7 show the detailed structure of the rotating member 104 that has a generally annular or tubular shape. The rotating member 104 has first end 110, second end 112, and axis of rotation A104 that runs from the first end 110 to the second end 112. The first end 110 comprises an abutment portion in the form of an annular flange 118 that has a nominal typical wall thickness 600 along its axis of rotation A104 and a thickness or length that extends along the radial direction R104 of the rotating member 104. The second end 108 comprises a tube or sleeve portion that has exterior peripheral or cylindrical surface 116 with ridges or ribs 114 on it for engaging the inside of a spool of material in a frictionally desirable manner, helping to keep the spool from falling off the dispenser 100. The cross section of one of the ribs 114 may include a semi-circular shape having a radius of .156 of an inch when looking at a cross-section taken along the radial direction R104 of the rotating member 104. Ends 624 of the ribs 114 adjacent an outside extremity 626 of the second end 112 of the rotating member 104 may be angled at 45 degrees from the axis of rotation A104, providing a lead-in for inserting the rotating member 104 into a spool of material. The rotating member 104 has a nominal or typical wall 600 that varies from 0.045 to 0.085 of an inch with an average of 0.65 of an inch. The central hole 628 of the rotating member 104 is sized or has a diameter D628 to receive the second end 108 of the holding member 102 as it is slightly greater than the outside diameter D106 of the second end 106 of the holding member 102. A blend 630 along the entry of this hole 628 near or proximate the first end 110 of the rotating member 104 is present to provide a lead-in for inserting the holding member 102 into the rotating member 104. The outer diameter of the flange D118 is substantially the same as the outer diameter D106 of the first end 106 of the holding member 102. Of course, it is contemplated that the dimensions associated with various features of the rotating member could be changed depending on the application as long as it would work properly with the holding member and vice versa.

Figure 9:
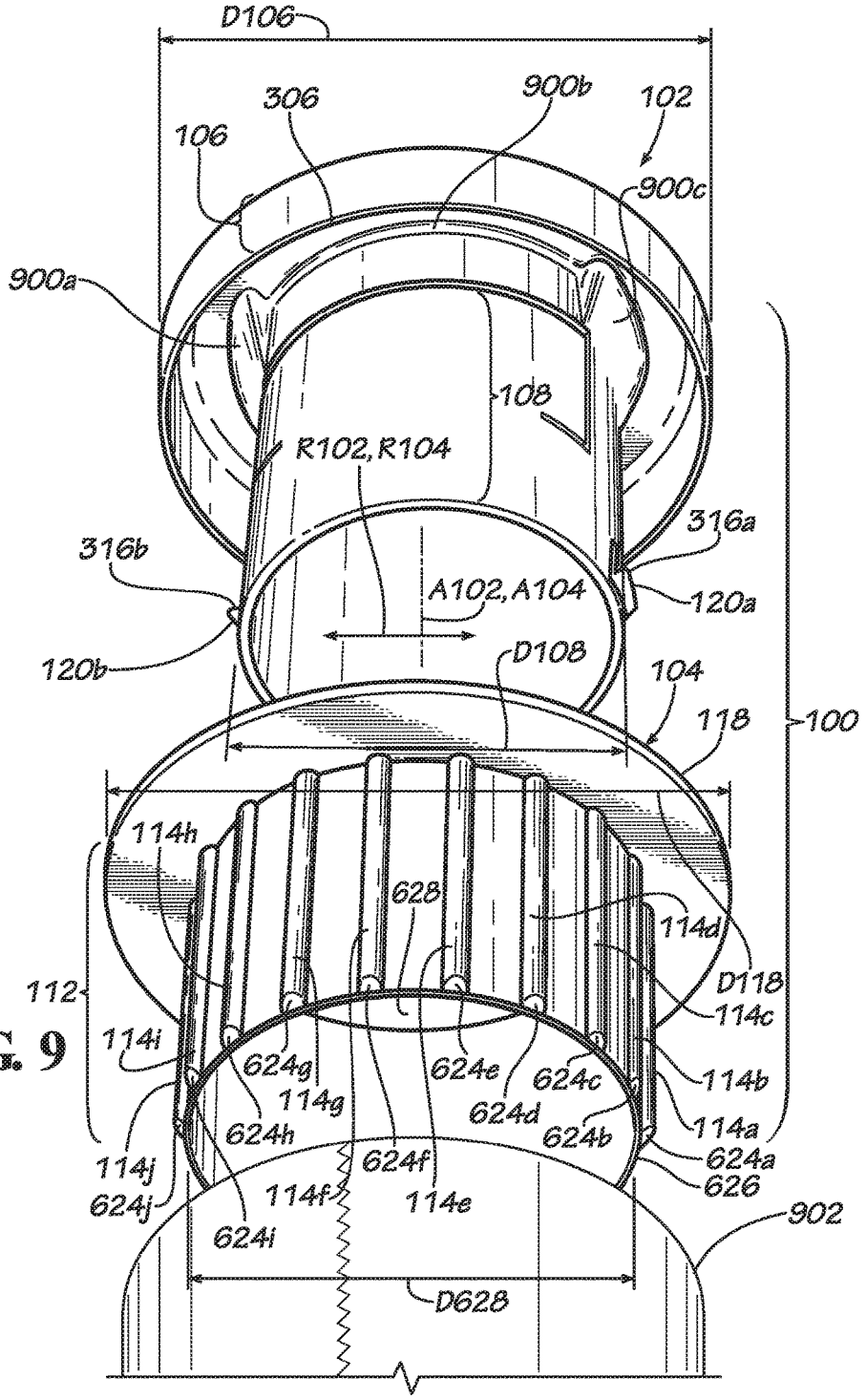
FIG. 9 is an alternate bottom oriented exploded assembly view of the film dispenser of FIG. 1 being assembled together with a spool of film.
Figure 10:
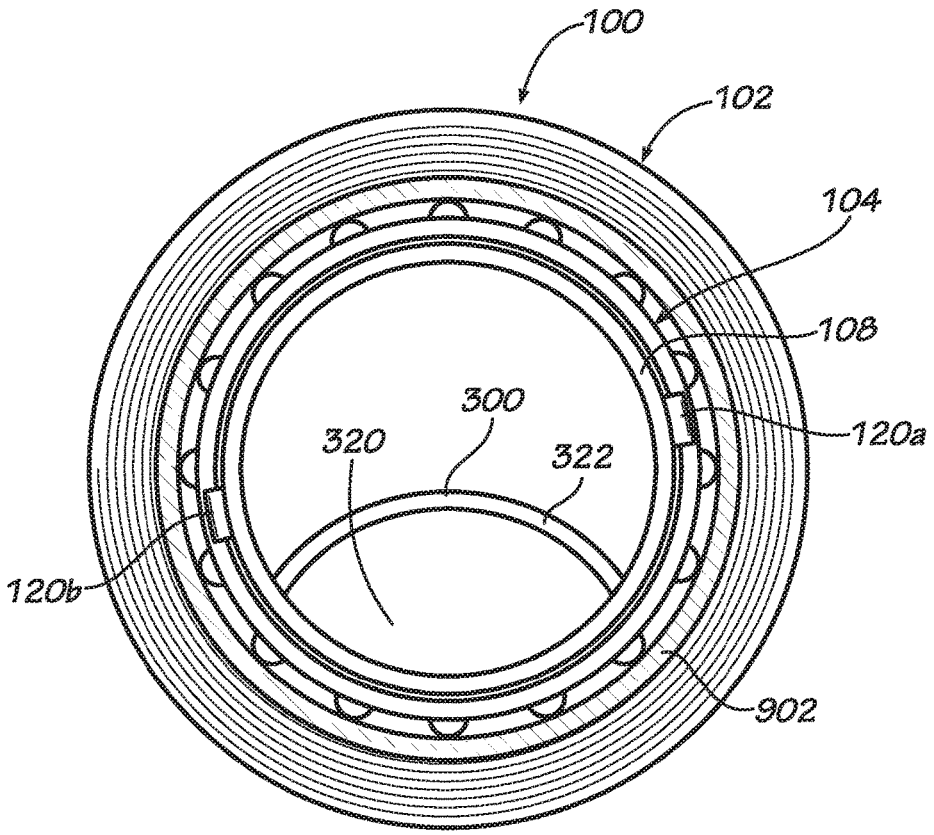
FIG. 10 is a cross-sectional view of the dispenser and spool of FIG. 9 after all three components (dispenser holding member, dispenser rotating member, and spool) have been assembled.

Finally, FIGS. 8, 9, and 10 show how the holding member 102 and rotating member 104 may be assembled and how the dispenser 100 is effectively coupled to a spool 902 of material. First, the rotating member 104 is inserted into the hole of the spool 902 until its abutment portion or first end 110 contacts the end of the spool. At this point, the ridges or ribs 114 are completely enveloped in the spool and are frictionally holding the rotating member 104 in the spool (seen best in FIG. 10). Next, the second end 108 of the holding member 102 is inserted into the central hole 628 of the rotating member 104 since the outside diameter D108 of the second end 108 of the holding member 102 is less than the diameter D628 of the hole 628 of the rotating member 104. As the holding member 102 is inserted into the rotating member 104, the snaps 120*a*, 120*b* are pushed radially inward as previously described until the second end 108 of the holding member 102 extends past the second end 112 of the rotating member 104, at which time the snaps 120*a*, 120*b* are released and the catch surfaces 316*a*, 316*b* of the snaps 120*a*, 120*b* capture the outside extremity 626 of the second end 112 of the rotating member 104. At about the same time, the abutment portion 118 contacts or nearly contacts the inside extremity 306 of the first end 106 of the holding member 102 as the diameter D118 of the flange 118 of the rotating member 104 is about the same as the outside diameter D106 of the first end 106 of the holding member 102. Thus, the first end 106 of the holding member 102 is spaced away from the sheet that is moving from the spool 902 when the dispensing is happening. The rotating member 104 fits between the snaps 102*a*, 102*b* and inside extremity 306 of the first end 106 of the holding member 102 because the overall length L104 of the rotating member 104 is less than the distance L102 from the inside extremity 306 to the catch surfaces 316*a*, 316*b* of the snaps 120*a*, 120*b* (best seen in FIGS. 4, 5 and 7). FIG. 10 shows the spool 902, rotating member 104, and holding member 102 completely assembled.

This process is then repeated on the other side of the spool so that two dispensers 100*a*, 100*b* are found at either end of the spool 902. The user can then use the dispensers 100*a*, 100*b* to unroll material from the spools 902 as has already been described. See FIG. 11A and 11B for illustrations of how the dispenser 100 is used to dispense film and how a dispenser 100 is held in the hand of the user. Once attached to a spool 902, it is difficult to detach a dispenser 100 as access to the latch or snap 120 is not readily provided. However, it is contemplated that a release mechanism that is operatively associated with the snaps 120 may be provided inside the holding member 102 that can be reached and activated for detaching the spool 902 if desired. Alternatively, once the material has been expended from the spool 902, the core can be cut open and access to the latch can be achieved and the dispenser removed if desired. In other cases, when the snap fit between the holding member and the rotating member is aggressive enough and the frictional fit between the spool and the rotating member is not too great, the entire film dispenser may pulled out by exerting enough force on the holding member to pull the dispenser out of the spool FIG. 9 also shows that the underside of the mushroom or umbrella shaped first end 106 of the holding member 102 lacks any ribs or gussets but such structure can be provided if desired to help give structural support to the first end 106 of the holding member 102 and to prevent warping of the first end of the holding member 102 as may occur when heat builds up in areas surrounded by three walls of plastic. Also, contoured surfaces 900*a*, 900*b*, 900*c* can be seen that mimic the surfaces found on the top side of the first end 106 of the holding member 102 that provide chamfers and blends and are offset from them, allowing the nominal wall to be maintained.

Finally, FIG. 11B shows the way a dispenser 100 fits into the hand of the user, allowing the fingers to fit within the central hole 128 of the holding member 102 and the thumb and portion of the palm to be placed on the exterior holding surface 122 of the holding member 102 seen. As the film is being dispensed, a clenching of the hand will necessarily cause the brake portion 302 of the holding member 102 to move radially outward and impinge on the rotating member 104, causing the rotating member 104 to slow down or stop rotating altogether, resulting in tensioning or even stretching of the film to occur provided the user continues to move the spool 902, all as has been previously described.

It should be noted that any of the steps of any of the methods described herein may be performed in any order or could be performed in sub-steps that are done in any order or that are separated in time from each other by other steps or sub-steps. Similarly, the steps of inserting the holding member 102 into the rotating member 104 and inserting the rotating member 104 into the spool 902 or roll can be done in any order as both effectuate the same end result, that is to say, the dispenser is operatively engaged with the spool 902 or roll. The same principle should be applied to any step of any method disclosed herein. Additional steps may also be added. For example, the method or device necessary to make the holding member 102 actually be rotationally attached to the rotating member 104 may be performed after the holding member 102 has been inserted into the rotating member 104 and before both have been inserted into the spool 902 or roll.

This assembly configuration represents one of many possible assembly configurations. One skilled in the art will understand obvious variations of this assembly configuration are included within this disclosure, including variations of steps, combinations of steps, and dissections of steps, among others. Where materials are chosen for the elements of this assembly—particularly, rubber, metal, and plastic—similar material choices may also be used and would be obvious to one in the art. The rotating member 104 and/or the holding member 102 may be made of cast iron, steel, aluminum, titanium, copper, brass, various plastics, polymers, resins, or any material of sufficient strength to withstand the loads placed on them when dispensing film or other materials from a roll or spool 902 and yet be resilient enough to allow snapping of the holding member 102 and the rotating member 104 together as well as movement of the brake that is integrally formed on either the holding member 102 or rotating member 104. It is contemplated that many of the features that have been described herein to be on either the holding member 102 or the rotating member 104 could be switched to the other of the holding member 102 or the rotating member 104 including the snaps and that features found completely in one member could be split in some cases between the two members. Furthermore, the configuration of either member need not be annular but could be something else depending on the application. Finally, additional members may be added to the film dispenser assembly and various components may be split into other components. For example, an elastomeric component may be applied to the handle portion of the holding member 102 to aid in grip and ergonomics. In such a case, the elastomeric component would be considered a portion of the holding member 102. This elastomeric component could be added to a plastic holding member using two shot molding technology or by other methods known or that will be devised in the art.

It should be emphasized that the embodiments described herein are merely possible examples of implementations, merely set forth for a clear understanding of the principles of the present disclosure. Many variations and modifications may be made to the described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

That which is claimed is:

1. A film dispenser comprising a holding member, the holding member comprising:
- a first end; and
- a second end joined to the first end, the holding member defining a longitudinal axis extending from the first end to the second end, the second end defining:
  - a brake portion defining a width measured in a direction perpendicular to the longitudinal axis and a length measured in a direction parallel to the longitudinal axis;
  - a connecting portion extending radially inward from the brake portion; and
  - a slot defined in the brake portion, the slot comprising a first portion extending in a circumferential direction across the width of the brake portion and a second portion and a third portion extending across the length of the brake portion, the second portion and the third portion distal from each other on opposing sides of the brake portion, the slot further comprising a fourth portion angled with respect to the second portion and a fifth portion angled with respect to the third portion, the fourth portion and the fifth portion extending in a circumferential direction, the fourth portion of the slot intersecting the second portion of the slot and the fifth portion of the slot intersecting the third portion of the slot.

2. The film dispenser of claim 1, wherein the first end of the holding member comprises an exterior holding surface having a constant radius of curvature about the full circumference of the holding member.

3. The film dispenser of claim 1, wherein the first end of the holding member comprises a handle and defines an interior holding surface and wherein the interior holding surface is curved and has a radius of curvature that is not concentric with the longitudinal axis.

4. The film dispenser of claim 1, wherein the first end of the holding member comprises a blend extending along the circumference of a central hole of the holding member.

5. The film dispenser of claim 1, wherein the first end of the holding member defines a chamfered region extending from an edge of a central hole of the holding member.

6. The film dispenser of claim 5, wherein the first end of the holding member defines two chamfered regions extending from an edge of a central hole of the holding member and positioned opposite each other relative to the longitudinal axis.

7. The film dispenser of claim 1, wherein each of the fourth portion and the fifth portion of the slot extends in a circumferential direction at least partially across the width of the brake portion.

8. The film dispenser of claim 1, wherein the fourth portion is angled at 90 degrees with respect to the second portion and the fifth portion is angled at 90 degrees with respect to the third portion.

9. The film dispenser of claim 1, wherein the fourth portion of the slot begins at an end point of the second portion of the slot and the fifth portion of the slot begins at an end point of the third portion of the slot.

10. The film dispenser of claim 9, further comprising a rotating member comprising a first end and a second end, the rotating member defining an axis of rotation that extends from the first end to the second end, the longitudinal axis of the holding member aligned with the axis of rotation of the rotating member; wherein the first end of the holding member comprises an inside extremity and a distance from the inside extremity of the first end of the holding member to the snap measured in direction that is parallel to the longitudinal axis of the holding member is greater than an overall length of the rotating member measured in direction that is parallel to the axis of rotation of the rotating member, the rotating member able to fit between the snap and the inside extremity of the first end of the holding member.

11. The film dispenser of claim 1, wherein the holding member further comprises a snap proximate to an outside extremity of the second end of the holding member, the defining a slot.

12. The film dispenser of claim 11, wherein the snap has a ramp surface angled from the longitudinal axis and configured to provide a camming motion to the snap as the holding member is inserted into the rotating member.

13. A method of braking a film dispenser, the method comprising:

holding the film dispenser by gripping an interior holding surface and an exterior holding surface of a holding member of the film dispenser, the holding member comprising a first end, a second end, and a brake portion, the holding member defining a longitudinal axis that extends from the first end to the second of the holding member;

dispensing film from a film roll of the film dispenser by rotating the film roll about the second end of the holding member, the longitudinal axis of the holding member aligned with an axis of rotation of the film roll; and braking the film dispenser by pressing the brake portion of the holding member to at least indirectly engage the brake portion with the film roll to increase a tension in the film being dispensed, the brake portion comprising a width and a length, the brake portion defined in the second end of the holding member by a slot, the slot comprising a first portion extending in a circumferential direction across the width of the brake portion and a second portion and a third portion extending across the length of the brake portion, the first portion and the second portion of the slot distal from each other on opposing sides of the brake portion, the slot further comprising a fourth portion and a fifth portion extending in a circumferential direction, the fourth portion of the slot intersecting the second portion of the slot and the fifth portion of the slot intersecting the third portion of the slot.

14. The method of claim 13, wherein each of the fourth portion and the fifth portion of the slot extend at least partially across the width of the brake portion.

15. The method of claim 13, wherein the film dispenser further comprises a rotating member comprising a first end and a second end, the rotating member defining an axis of rotation that extends from the first end to the second end, the longitudinal axis of the holding member aligned with the axis of rotation of the rotating member.

16. The method of claim 15, wherein the holding member further comprises a snap proximate to an outside extremity of the second end of the holding member.

17. The method of claim 16, wherein the snap defines a slot.

18. The method of claim 16, wherein the first end of the holding member comprises an inside extremity and a distance from the inside extremity of the first end of the holding member to the snap measured in direction that is parallel to the longitudinal axis of the holding member is greater than an overall length of the rotating member measured in direction that is parallel to the axis of rotation of the rotating member, the rotating member configured to fit between the snap and the inside extremity of the first end of the holding member.

19. The method of claim 15, wherein the first end of the holding member defines a chamfered region extending from an edge of a central hole of the holding member, the method further comprising contacting the chamfered region with a hand of the user.

20. The method of claim 19, wherein the first end of the holding member defines two chamfered regions extending from an edge of a central hole of the holding member and positioned opposite each other relative to the longitudinal axis, the method further comprising contacting both chamfered regions with a hand of the user.

* * * * *